US007080470B2

(12) United States Patent
Jones

(10) Patent No.: US 7,080,470 B2
(45) Date of Patent: Jul. 25, 2006

(54) WEAR ASSEMBLY FOR EXCAVATOR DIGGING EDGE

(75) Inventor: Larren F. Jones, Portland, OR (US)

(73) Assignee: ESCO Corporation, Portland, OR (US)

( * ) Notice: Subject to any disclaimer, the term of this patent is extended or adjusted under 35 U.S.C. 154(b) by 59 days.

(21) Appl. No.: 10/425,605

(22) Filed: Apr. 30, 2003

(65) Prior Publication Data

US 2004/0216335 A1 Nov. 4, 2004

(51) Int. Cl.
*E02F 9/28* (2006.01)

(52) U.S. Cl. ..... 37/452; 37/456; 403/378

(58) Field of Classification Search ..... 403/379.5, 403/378, 379; 37/446, 447, 449, 450–459; 172/772, 772.5, 753, 713
See application file for complete search history.

(56) References Cited

U.S. PATENT DOCUMENTS

| | | | | |
|---|---|---|---|---|
| 1,031,138 A | | 7/1912 | McKee et al. | |
| 1,076,548 A | | 10/1913 | Butler | |
| 1,485,243 A | * | 2/1924 | Blake | 37/451 |
| 1,775,984 A | * | 9/1930 | Younie | 37/452 |
| 1,959,847 A | | 5/1934 | Buskirk | |
| 3,160,967 A | | 12/1964 | Nichols | |
| 3,685,177 A | | 8/1972 | Hahn et al. | |
| 3,736,664 A | | 6/1973 | Black et al. | |
| 3,841,007 A | | 10/1974 | Howarth et al. | |
| 3,851,413 A | * | 12/1974 | Lukavich | 37/451 |
| 3,864,853 A | | 2/1975 | Klett et al. | |
| 3,947,982 A | | 4/1976 | Mantovani | |
| 3,974,579 A | | 8/1976 | Black et al. | |
| 3,995,384 A | | 12/1976 | Wood | |
| 4,006,544 A | | 2/1977 | Stepe | |
| D245,780 S | | 9/1977 | Dahlberg et al. | |

(Continued)

FOREIGN PATENT DOCUMENTS

WO WO 02/12642 2/2002

OTHER PUBLICATIONS

ESCO Brochure: "Instructions for T4–V71, T4L–V71, & T4R–V&1 Toplok® Adaptors", M/LMS–504–0302, 2002, pp. 1–8.
ESCO Booklet; "ESCO Toplok Adapter System For Plate Lips", Mining College '97, DMC Sep. 9, 1997, Illustrations 1–23.
Clark Equipment, Bucket Tooth Adater Installation Drawing, No. 1546546, Mar. 13, 1970.

*Primary Examiner*—Thomas B. Will
(74) *Attorney, Agent, or Firm*—Banner & Witcoff, Ltd.

(57) ABSTRACT

A wear assembly that includes a wear member and a boss to define an opening for receiving a lock forward of the front edge face of the lip which can mount the wear member in a stable and balanced manner without a through-hole in the lip. The wear member includes an aperture and a rib to define bearing faces on opposite sides of a central plane of the lip. The boss includes rails to hold the wear member in place, and a brace at the rear end, which supports the rails on the boss, abuts the rear of the wear member to reduce the loading on the lip, and deflects earthen material away from the wear member under reverse loading.

92 Claims, 14 Drawing Sheets

U.S. PATENT DOCUMENTS

| | | | | | |
|---|---|---|---|---|---|
| 4,103,442 | A | | 8/1978 | Zepf | |
| 4,205,469 | A | | 6/1980 | Johansson et al. | |
| 4,449,309 | A | | 5/1984 | Hemphill | |
| 4,457,380 | A | | 7/1984 | Curry | |
| 4,501,079 | A | | 2/1985 | Hahn et al. | |
| 4,570,365 | A | | 2/1986 | Bierwith | |
| 4,716,667 | A | * | 1/1988 | Martin | 37/453 |
| 4,748,754 | A | | 6/1988 | Schwappach | |
| 5,005,304 | A | | 4/1991 | Briscoe et al. | |
| 5,016,365 | A | | 5/1991 | Robinson | |
| 5,052,134 | A | | 10/1991 | Bierwith | |
| 5,063,695 | A | | 11/1991 | Briscoe et al. | |
| 5,075,986 | A | | 12/1991 | Smith et al. | |
| 5,088,214 | A | | 2/1992 | Jones | |
| 5,241,765 | A | | 9/1993 | Jones et al. | |
| 5,283,965 | A | | 2/1994 | Clendenning | |
| 5,325,615 | A | * | 7/1994 | Hutchins et al. | 37/455 |
| 5,396,964 | A | | 3/1995 | Shellhorn et al. | |
| 5,412,885 | A | | 5/1995 | Cornelius | |
| 5,438,774 | A | | 8/1995 | Fletcher et al. | |
| 5,465,512 | A | | 11/1995 | Livesay et al. | |
| 5,553,409 | A | * | 9/1996 | Irving | 37/446 |
| 5,564,508 | A | | 10/1996 | Renski | |
| 5,634,285 | A | | 6/1997 | Renski | |
| 5,653,048 | A | | 8/1997 | Jones et al. | |
| 5,713,145 | A | | 2/1998 | Ruvang | |
| 5,806,216 | A | | 9/1998 | Renski | |
| 5,852,888 | A | | 12/1998 | Cornelius | |
| 5,937,549 | A | | 8/1999 | Bender et al. | |
| 5,992,063 | A | | 11/1999 | Mack | |
| 6,145,224 | A | | 11/2000 | Stickling | |
| 6,151,812 | A | | 11/2000 | Bierwith | |
| 6,194,080 | B1 | | 2/2001 | Stickling | |
| 6,209,238 | B1 | | 4/2001 | Ruvang | |
| 6,393,739 | B1 | * | 5/2002 | Shamblin et al. | 37/456 |
| 6,729,052 | B1 | * | 5/2004 | Ollinger et al. | 37/452 |

* cited by examiner 38
39
52
120
57
54
120
50
64
48
93
60
42
26
24
25
36
32
40
20
25
24
22
36
30
36

93
39
48
42
52
64
38
20
26
60
24
22
58
24
36
30

WEAR ASSEMBLY FOR EXCAVATOR DIGGING EDGE

FIELD OF THE INVENTION

The present invention pertains to a wear assembly for protecting the front edge of a structure subjected to wear, and is particularly suited for use along the front digging edge of an excavating bucket or the like.

BACKGROUND OF THE INVENTION

Excavating buckets and other excavating equipment are typically subjected to harsh conditions. A series of wear members are usually provided to protect the digging edges from premature wear. Wear members have been secured to the digging edge in many different ways.

For example, in U.S. Pat. No. 4,570,365 to Bierwith, the wear members are secured to the lip of the bucket by the use of a wedge and spool lock arrangement that is fit through a hole in the lip spaced from the front edge. In this arrangement, the spool pinches the rear parts of the wear member against the inner and outer faces of the lip as the wedge is driven into the hole. However, under load, the legs of the wear member can shift and cause loosening of the lock and possible loss of the wear member. In addition, the formation of a hole in the lip weakens the lip and its ability to effectively resist the large loads applied as the lip is forced into the ground.

In U.S. Pat. No. 3,995,384 to Wood and U.S. Pat. No. 4,748,754 to Schwappach, the hole in the lip is eliminated and replaced with a lateral boss that is welded to the inner face of the lip generally parallel to the front edge. While these constructions avoid weakening the lip with a through-hole, they place very large loads on the lateral boss, and thus, can only be reliably used in low stress environments.

In U.S. Pat. No. 5,088,214, the wear member is secured by a boss that is welded to the inner face of the lip so as to extend generally normal to the front edge. The wear member, then, is slipped over the boss via a complementary slot. As can be appreciated, this orientation of the boss greatly reduces the loads on the boss as compared to the lateral bosses. Nevertheless, the wear member is typically secured by a single lock located to one side of the lip. While this is adequate for most applications, this arrangement does orient the lock in an off-center relationship relative to the lip and thus engenders increased vertically oriented stresses on the legs of the wear member as well as the lip. Greater balance in resisting the loads applied to the wear member can be achieved by utilizing a boss and lock for the inner and outer legs (see, e.g., FIG. 5 of the '214 patent). However, this construction requires more steel and twice as many bosses and locks for the attachment of each wear member.

As a result, there is a need for an improved assembly for attaching a wear member to the digging edge of an excavator that avoids the problems of the prior art.

SUMMARY OF THE INVENTION

In accordance with one aspect of the invention, the wear member is secured to the lip of an excavator (e.g., an excavating bucket) in a stable and balanced manner without the formation of a through-hole in the lip. In a preferred construction, the wear assembly includes a boss and a wear member that cooperate to define a passage forward of the front edge face of the lip for receiving the lock. In this way, the lock can be engaged on each side of the central plane of the lip. The lip can be maintained as an imperforate member for greater strength and durability.

In another aspect of the present invention, the lip of the excavator includes an inner face, an outer face and a front edge face. The front edge face includes a plurality of spaced scallops. The scallops cooperate with the wear assembly to permit a through-hole for the lock to be formed forward of the lip without undue forward projection of the boss. The scallops are preferably formed by a concave wall that extends no more than about 180 degrees about an axis that is generally perpendicular to the lip. In this way, the scallop can provide the desired space for the lock without causing significant weakening of the lip.

In one other aspect of the invention, the wear member includes a pair of spaced bearing surfaces to contact the lock generally on opposite sides of the central plane of the lip. In a preferred construction, the wear member is bifurcated to define a pair of rearward legs. One of the legs includes an aperture into which the lock is received. A bearing surface associated with the aperture engages the lock on one side of the central plane of the lip to hold the wear member in place. The other leg includes a rib that extends toward the aperture. The rib includes a bearing surface to engage the lock on an opposite side of the central plane of the lip.

In another aspect of the invention, a boss includes a front part that extends along the front edge face of the lip and a body that extends along the inner or outer face of the lip. The body defines a hole forward of the front edge face of the lip to receive the lock for securing the wear member in place. In the preferred construction, the front part wraps around the lip to define a finger portion that opposes the body. The front part defines an opening that is aligned with the hole in the body to define a passage into which the lock is inserted.

In another aspect of the invention, the boss includes a body that extends along one of the faces of the lip. Rails extend along opposite sides of the boss to cooperate with a complementary structure on the wear member to hold the wear member in place. A brace extends laterally beyond at least part of the body and is fixed to the rails to provide enhanced support to the rails.

In one other aspect of the invention, the boss includes a body that extends along one of the faces of the lip and a brace at a rear end of the body. The brace extends beyond the body in a transverse direction to define a front bearing face against which a rear wall of the wear member can abut. In this way, the applied forces and stresses on the lip can be reduced to thereby lessen the maintenance requirements and lengthen the usable life of the lip.

In another aspect of the invention, the boss is formed with a raised deflector that tends to deflect earthen material away from the wear member when the excavator is reversed. In the preferred construction, the deflector is formed at the rear end of and extends farther from the lip than the forward portions of the boss to be juxtaposed to the rear wall of the wear member. An inclined deflector face is preferably formed to reduce the forces applied to the deflector under reverse loading.

DETAILED DESCRIPTION OF THE PRESENT INVENTION

In accordance with the present invention, a wear assembly 10 is provided for attachment along the digging edge of a lip of an excavator. The invention is discussed below in terms of the attachment of a shroud to the lip of a load-haul-dump (LHD) bucket. However, the invention is not limited to the attachment of a shroud or an LHD bucket. The invention could be used to secure other wear members to other excavators, and even to other equipment where the edge is subject to heavy loading and wear as in an excavating environment.

The invention is at times discussed in terms of relative terms, such as up, down, right, left, vertical, horizontal, etc. for the sake of easing the description. These terms are to be considered relative to the orientation of the elements in FIG. 1 (unless otherwise noted), and are not to be considered limitations on the invention. As can be appreciated, the wear member can be used and oriented in a variety of ways.

Figure 2:
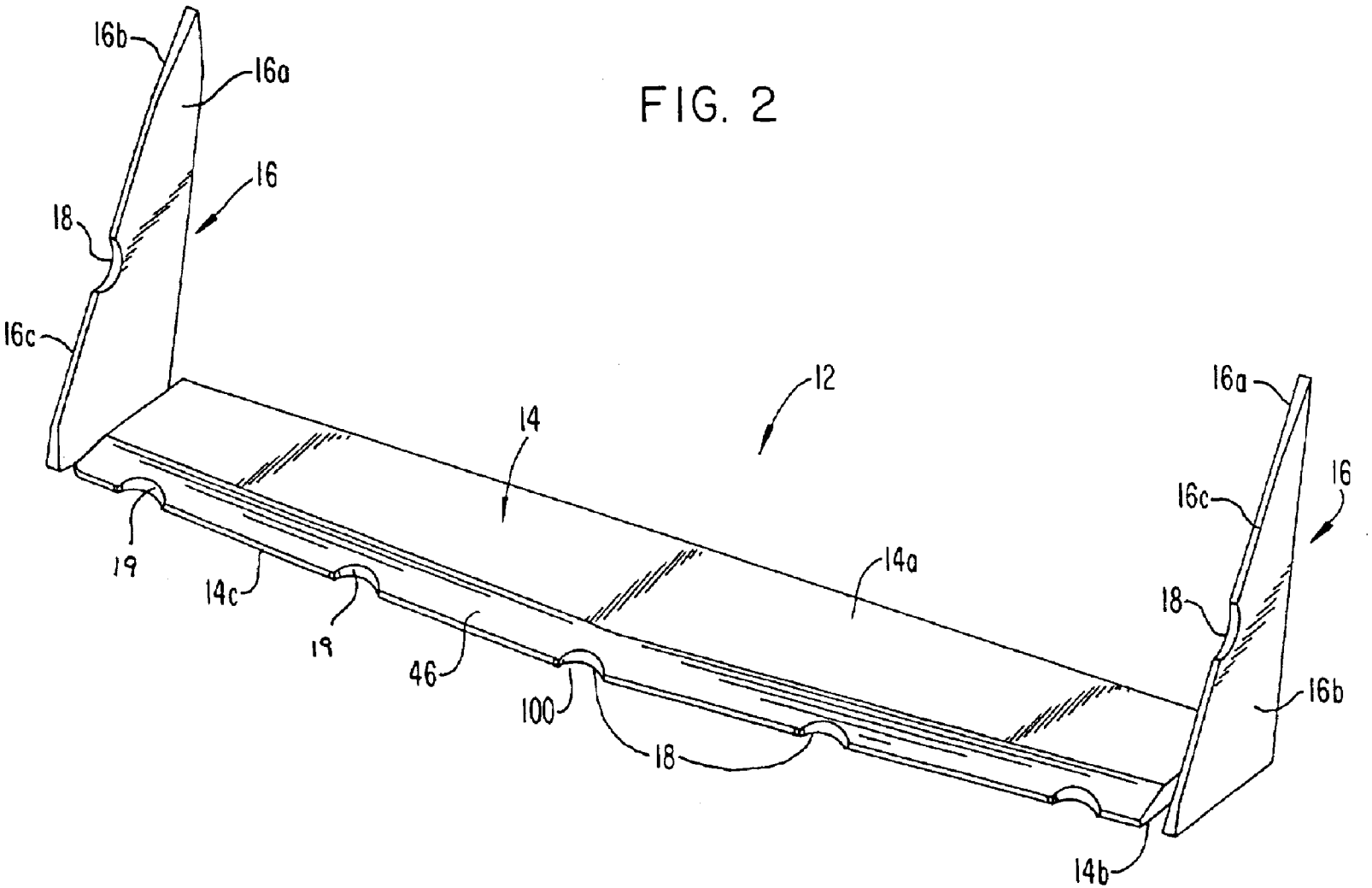
FIG. 2 is a perspective view of the lip in accordance of the present invention.

Lip 12 forms the front digging edge of an LHD bucket (not shown) to engage and penetrate into the ground for the gathering of earthen material. As seen in FIG. 2, lip 12 includes a center section or main member 14 that extends horizontally across the front of the bucket and a pair of corner sections 16 generally at right angles to the center section. Corner sections 16 form the lower ends of the front edges of the bucket sidewalls. Each of the lip sections includes an inner face 14*a*, 16*a*, an outer face 14*b*, 16*b*, and a front edge 14*c*, 16*c*. No through-holes are formed in the lip sections. Hence, the lip is able to provide a strong base to amply resist the high forces applied during use.

The front edges 14*c*, 16*c* of lip sections 14, 16 are defined with spaced scallops or recesses 18, one for each wear assembly 10. In the illustrated example, five uniformly spaced scallops are formed along front edge 14*c*, and one scallop in each of front edges 16*c*. The scallops are each preferably formed to have a uniform, continual, arcuate surface 19 with a curvature that extends no more than about 180 degrees about an axis extending generally perpendicular to the lip, and preferably is at about 180 degrees. In this way, lip 12 with scallops 18 can be easily manufactured, provide a robust base to resist the applied loads, and (as discussed below) provide clearance for the lock of wear assembly 10 during use. Nevertheless, the scallops could be formed to have a non-uniform curvature, a discontinuous or angular shape, and/or be formed to have partial closure (i.e., a surface with more than a 180 degree extension such that certain side portions of the scallop are opposed to each other). Each of these variations, though, tends to increase the cost of manufacture, lead to more significant stress concentrations, and/or reduced strength.

Figure 6:
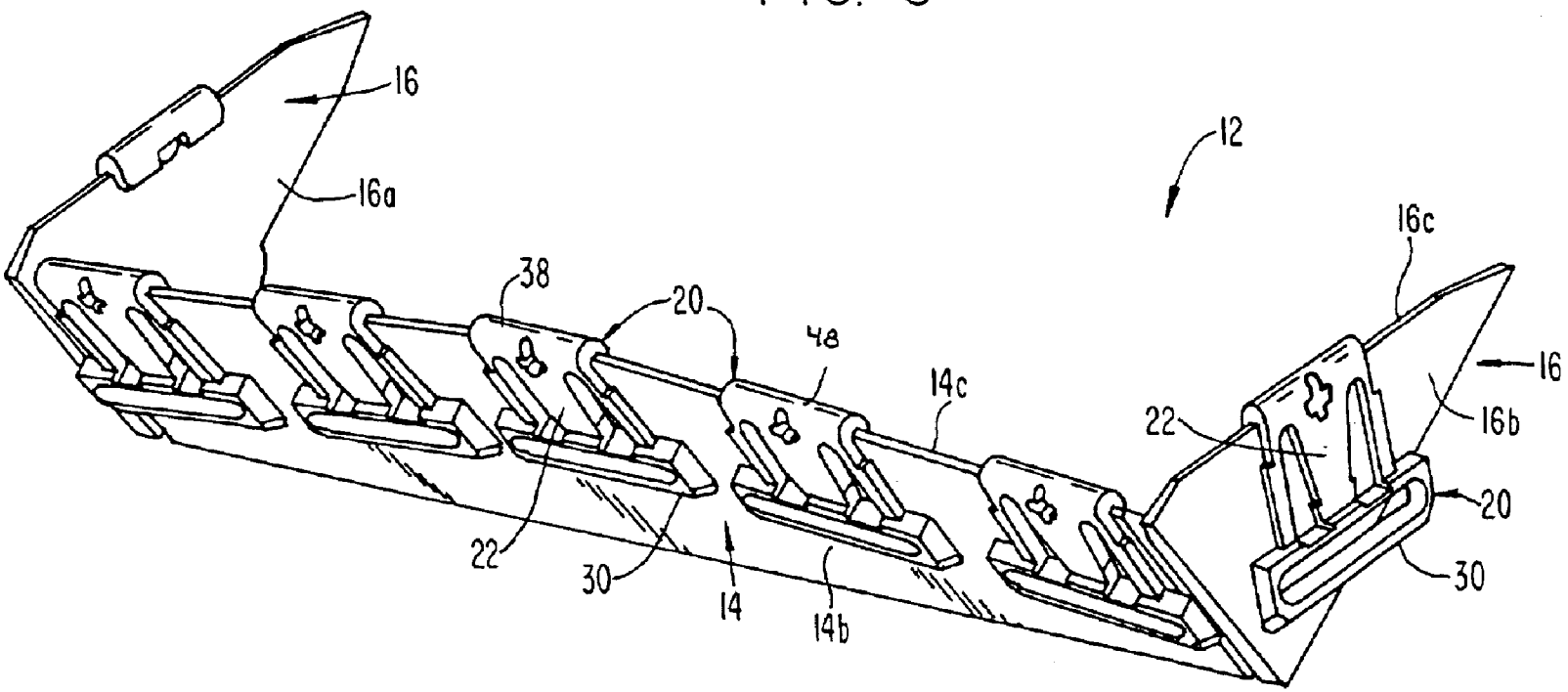
FIG. 6 is a perspective view of a series of the bosses attached to the lip.

As shown in FIG. 6, a boss 20 is fixed to lip 12 over each scallop 18. While bosses 20 are preferably welded to the lip, they could be cast as an integral part of the lip or secured by mechanical means. In addition, the bosses could each be formed as a multiple of parts, which are integral or spaced apart, although a one-piece member is preferred for simplicity and strength.

Figure 3:
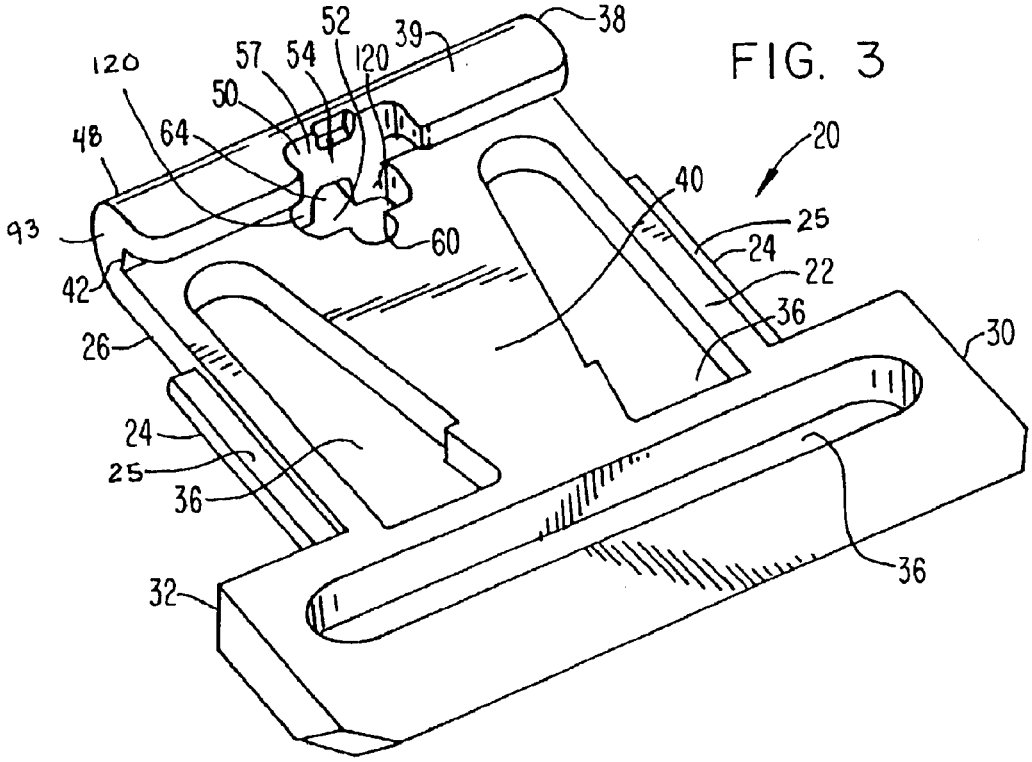
FIG. 3 is top perspective view of a boss in accordance with the present invention.
Figure 4:
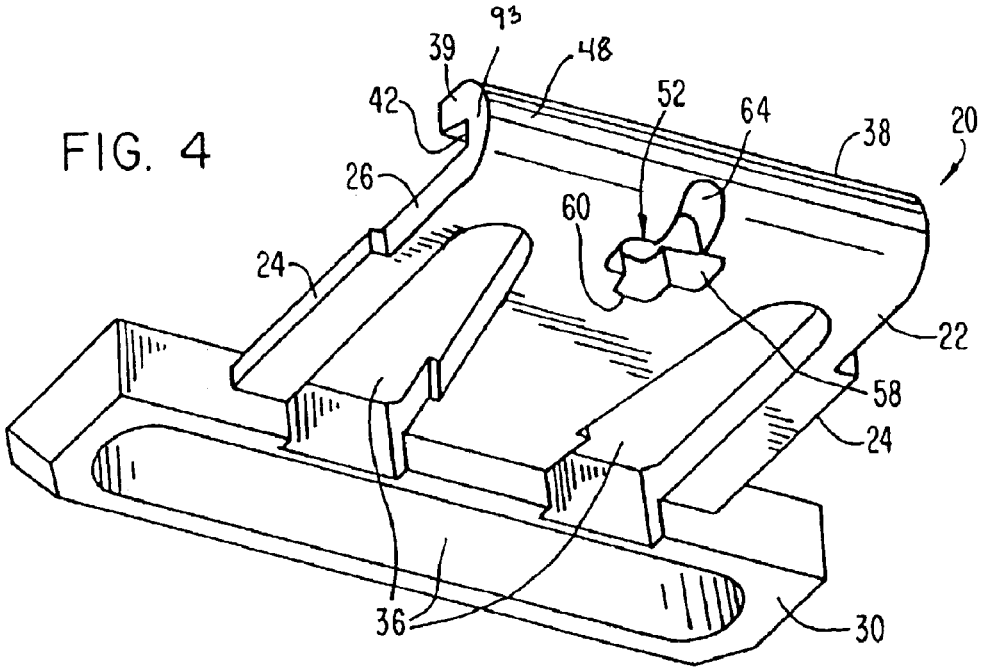
FIG. 4 is a bottom perspective view of the boss.
Figure 5:
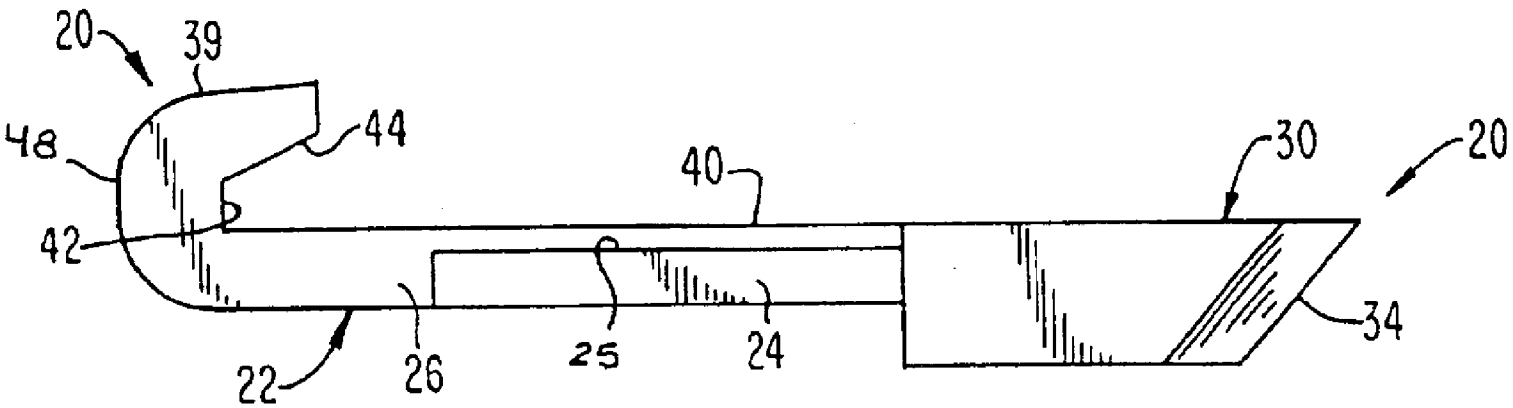
FIG. 5 is a side view of the boss.

Boss 20 has a body 22 extending along outer face 14*b* of lip 12 (FIGS. 3–5). Body 22 preferably includes a pair of rails 24 extending along sidewalls 26 in a rearward direction from front edge 14*c*, 16*c*. The rails project laterally outward from each sidewall 26 to form a T-shaped configuration. Rails 24 have holding surfaces 25 that are spaced from and facing outer face 14*b*, 16*b*. As discussed below, rails 24 cooperate with wear member or (in this case) shroud 28 to prevent its movement away from the lip. While a T-shaped configuration is preferred, the rails could have other shapes, such as dovetail. Moreover, for lower stress environments, the rails could be omitted entirely (not shown) so that only the sidewalls 26 defined the sides of the body.

A brace 30 extends laterally across the rear end of body 22. In the preferred construction, the rear ends of rails 24 are integrally fixed to a brace 30 to additionally support the rails when under load. Brace 30 further extends outward beyond the rails to define a stop surface 32 adapted to abut the rear end of shroud 28 and thereby reduce the stress on the boss, which in turn, reduces the stress along front edge 14*c*, 16*c* of lip 12. The use of a brace as an abutment and/or to support the rails has applicability in other arrangements for mounting wear members, such as disclosed in co-pending U.S. patent application Ser. No. 10/425,606, filed Apr. 30, 2003, and entitled "Wear Assembly for the Digging Edge of an Excavator," which is in its entirety hereby incorporated by reference.

Brace 30 also preferably has a greater depth than body 22 so that it extends from the lip a greater distance than the body to maximize the surface area able to abut the shroud and to function as a deflector for earthen material when the bucket is reversed to reduce reverse loading of shroud 28. A deflector face 34 inclined forward from outer face 14*b*, 16*b* is preferably formed along the rear side of brace 30 to direct the earthen material away from the assembled boss and shroud. Body 22 and brace 30 are formed as an open framework, with openings 36 to reduce the amount of needed steel and to facilitate welding of the boss to the lip.

A front part 38 of boss 20 wraps around front edge 14*c*, 16*c* of lip 12 to define a finger portion 39 along inner face 14*a*, 16*a*. Inner surface 40 of boss 20 (i.e., the surface that faces lip 12) is shaped to conform to the shape of the particular lip to which it is fixed. In this case, the inner face includes an upright face 42 to set against front edge 14*c*, 16*c* and an upper face 44 to set against ramp 46 of inner face 14*a*. In the preferred construction, the bosses attached to comer sections 16 are the same as those attached to center section 14. However, other attachments are possible. If the front of the lip had a curved or other shape, inner surface 40 would be changed to match the shape of the lip. The front face 48 of boss 20 preferably has a uniform curved shape, but other shapes are possible. Alternatively, front part 38 could be formed to simply be upturned to abut against front edge 14*c*, 16*c* and not overlie inner face 14*a*, 16*a*. Also, front part 38 could be entirely omitted so that boss 20 only lies along outer face 14*b*, 16*b*. In addition, body 22 could be fixed to inner face 14*a*, 16*a* instead of outer face 14*b*, 16*b* if desired.

Figure 7:
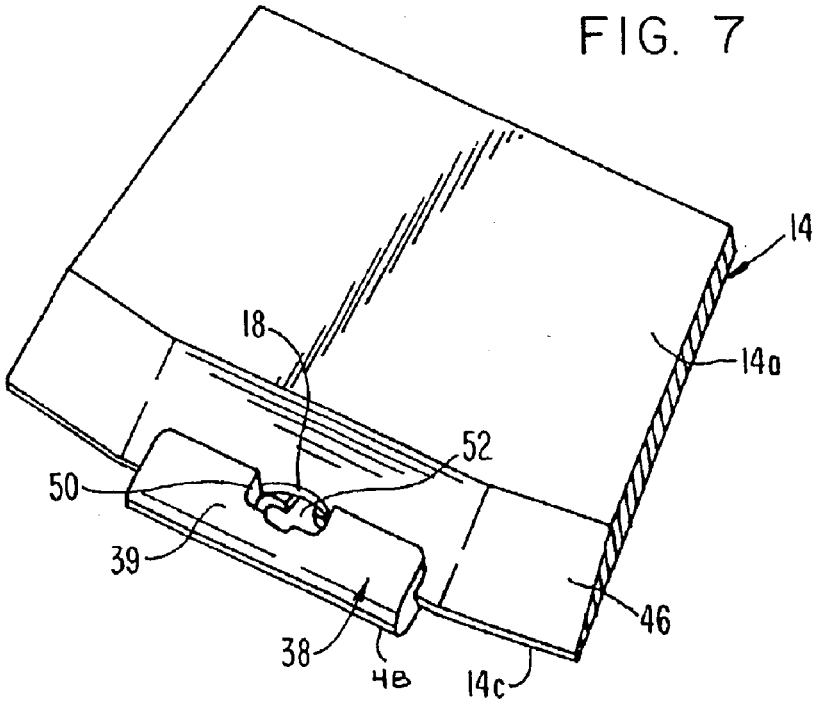
FIG. 7 is an enlarged top perspective view of one of the bosses attached to the lip.
Figure 8:
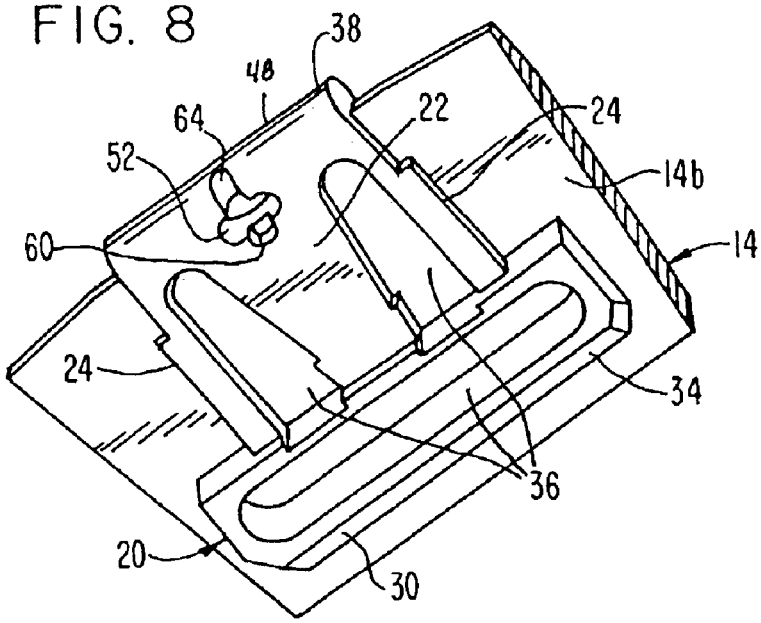
FIG. 8 is an enlarged bottom perspective view of one of the bosses attached to the lip.

A recess 50 is formed in finger portion 39. A hole 52 in body 22 is aligned with recess 60 to collectively define a passage 54 for receiving a lock 56. In the preferred construction, recess 50 has a generally U-shaped configuration; though other shapes are possible. The main wall 57 of recess 50 is preferably aligned with upright face 42 for bearing against the lock. Hole 52 has a main portion 58 that preferably has a laterally elongated, generally rectangular shape; though other shapes are possible. The shapes of recess 50 and hole 52 are largely dependent on the shape of the lock. While hole 52 preferably extends through body 22, it could have a closed lower end (which would result in the elimination of rib 62). A pocket 60 is defined along a medial section of main portion 58 to receive a rib 62 of shroud 28. A groove 64 is formed in front face 48 and through front part 38 to connect with main portion 58 of hole 52. Groove 64 is provided to permit the passage of rib 62 to pocket 60 and is thus aligned with pocket 60. Boss 20 is fixed to lip 12 such that recess 50 and hole 52 are centrally aligned with one of the scallops 18 (FIGS. 7 and 8).

In the preferred construction, shrouds 28 have a front working portion 66 that tapers to a narrowed front edge 68, and a rear mounting portion 70 that is bifurcated to define an inner leg 72 and an outer leg 74 (FIGS. 13–18). Outer leg 74 has a generally flat outer face 76 and a rear deflector face 78 that is inclined forwardly away from lip 12 to direct any earthen material away from the wear member during reverse movement of the bucket. The inner face 80 preferably has a pair of dogleg flanges 82 that face inward to define a T-shaped slot 84 for receiving body 22 and rails 24. Flanges 82 could vary in shape to define slot with a dovetail or other configurations which complement the shape of rails 24, or to simply be upright when no rails are provided. Alternatively, the flanges could be replaced with a thicker outer leg that includes inner walls to form the slot receiving the boss 20. Also, the tongue and groove arrangement could be reversed so that the boss was formed to define the slot and the wear member the tongue received into the slot (not shown).

Figure 13:
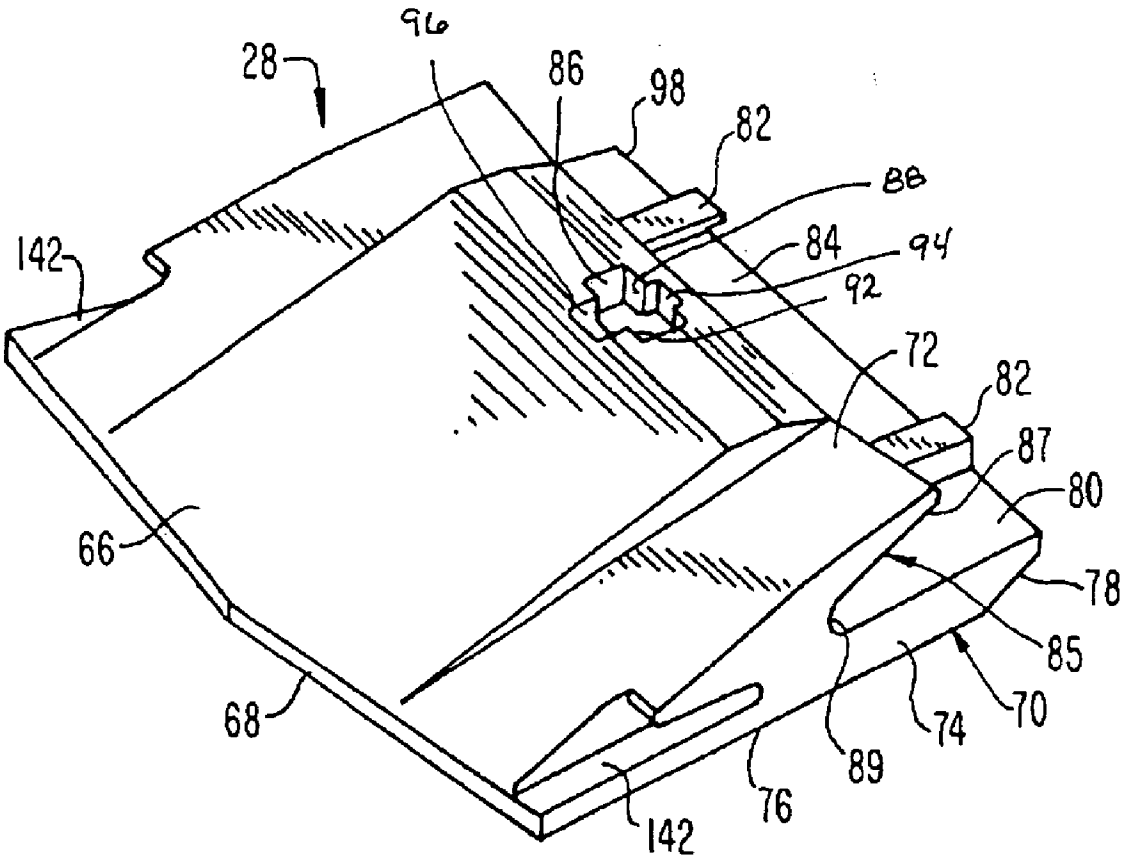
FIG. 13 is a top perspective view of a wear member in accordance with the present invention.
Figure 14:
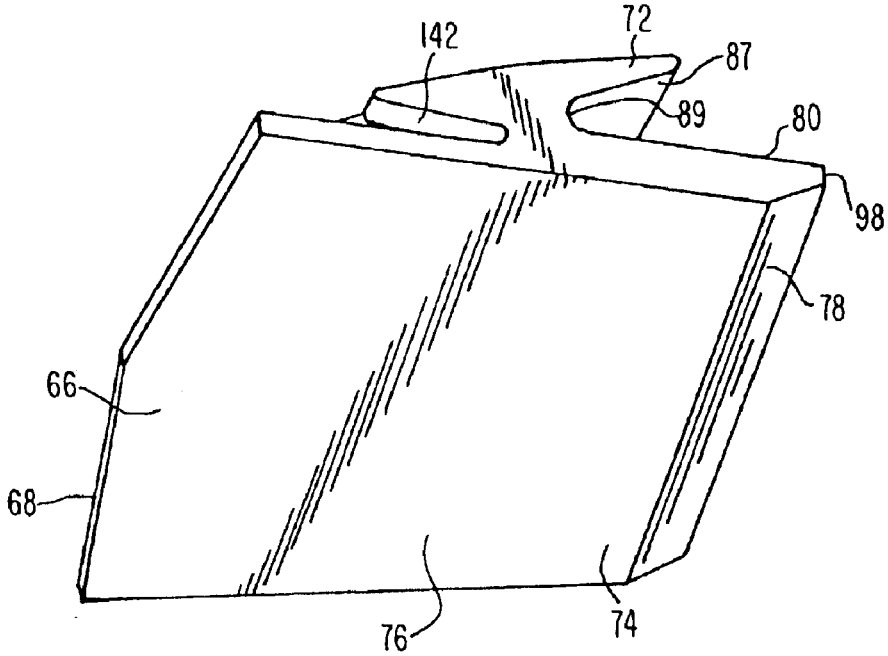
FIG. 14 is a bottom perspective view of the wear member.
Figure 15:
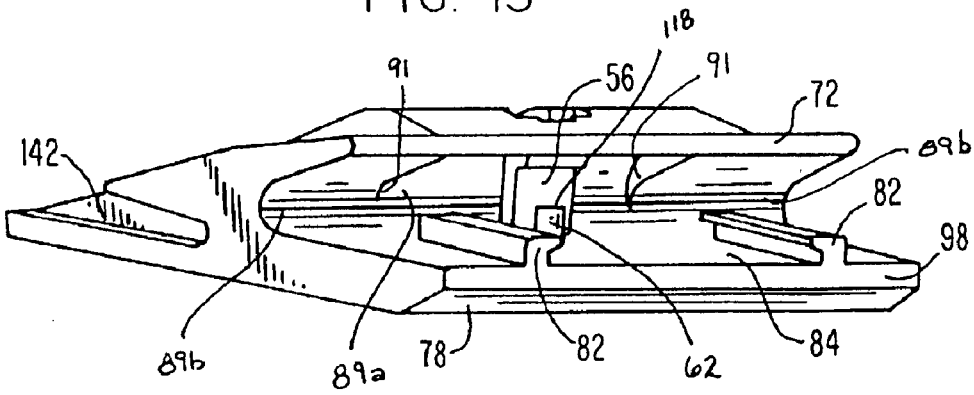
FIG. 15 is a rear view of the wear member and its relation to the lock during use.
Figure 16:
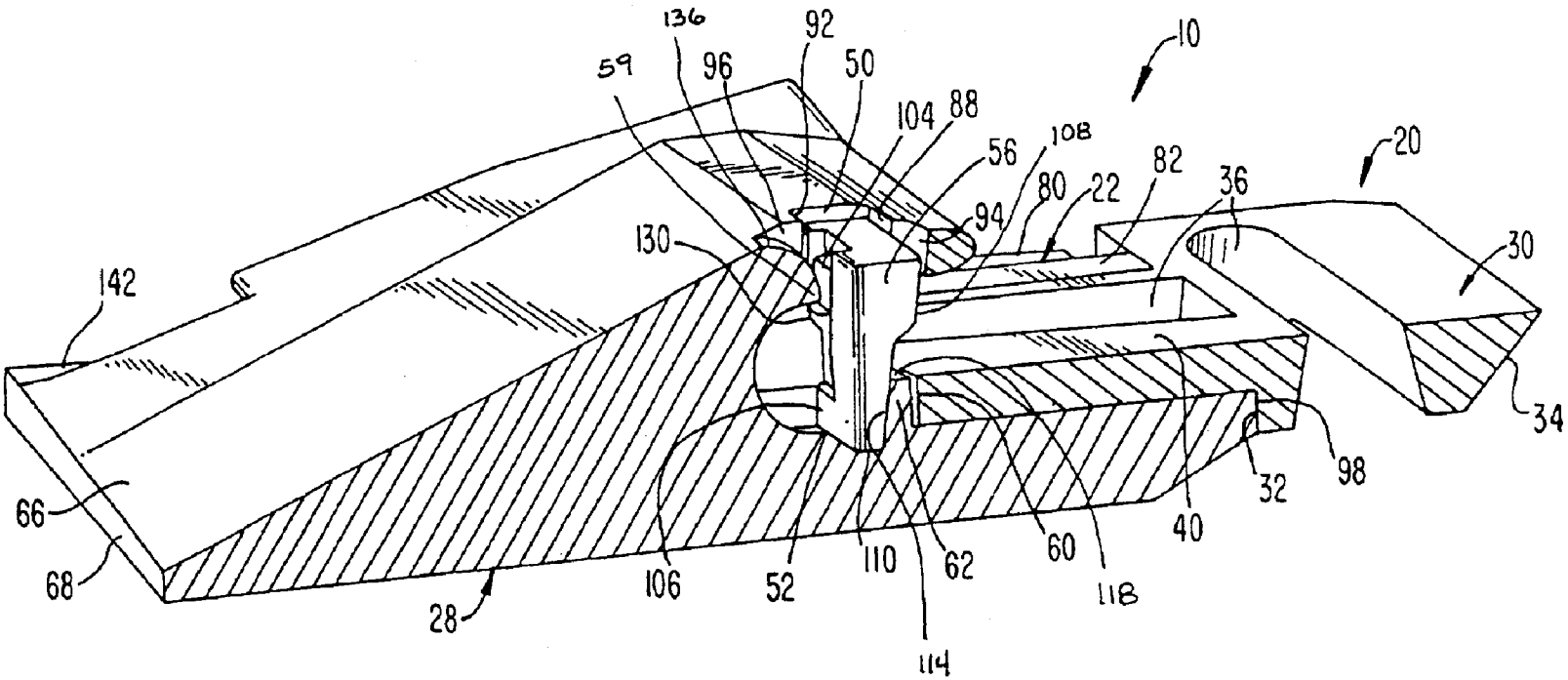
FIG. 16 is a cross-sectional view taken along line XVI—XVI in FIG. 1.
Figure 17:
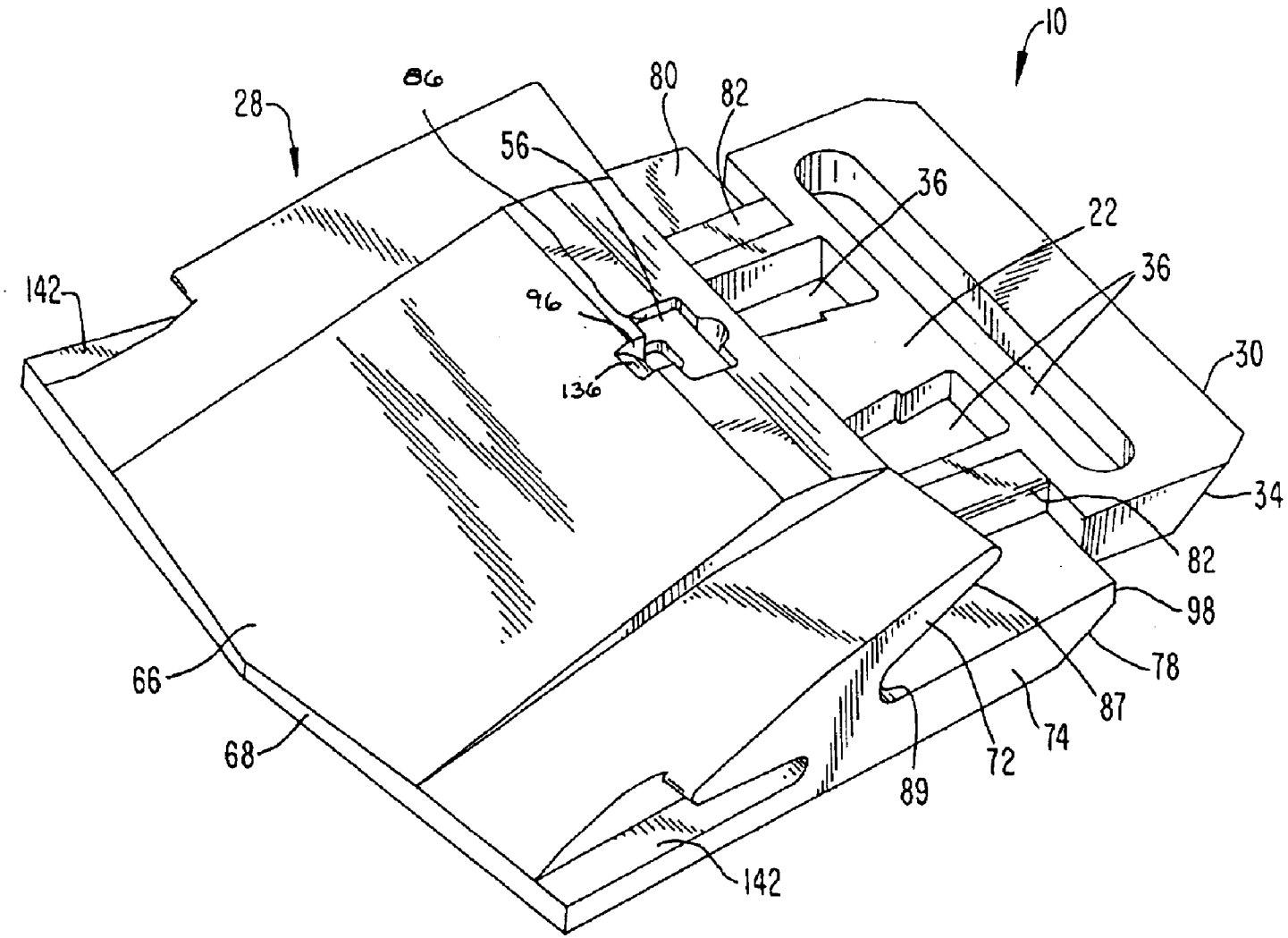
FIG. 17 is a top, front perspective view of the wear assembly with the lip omitted.
Figure 18:
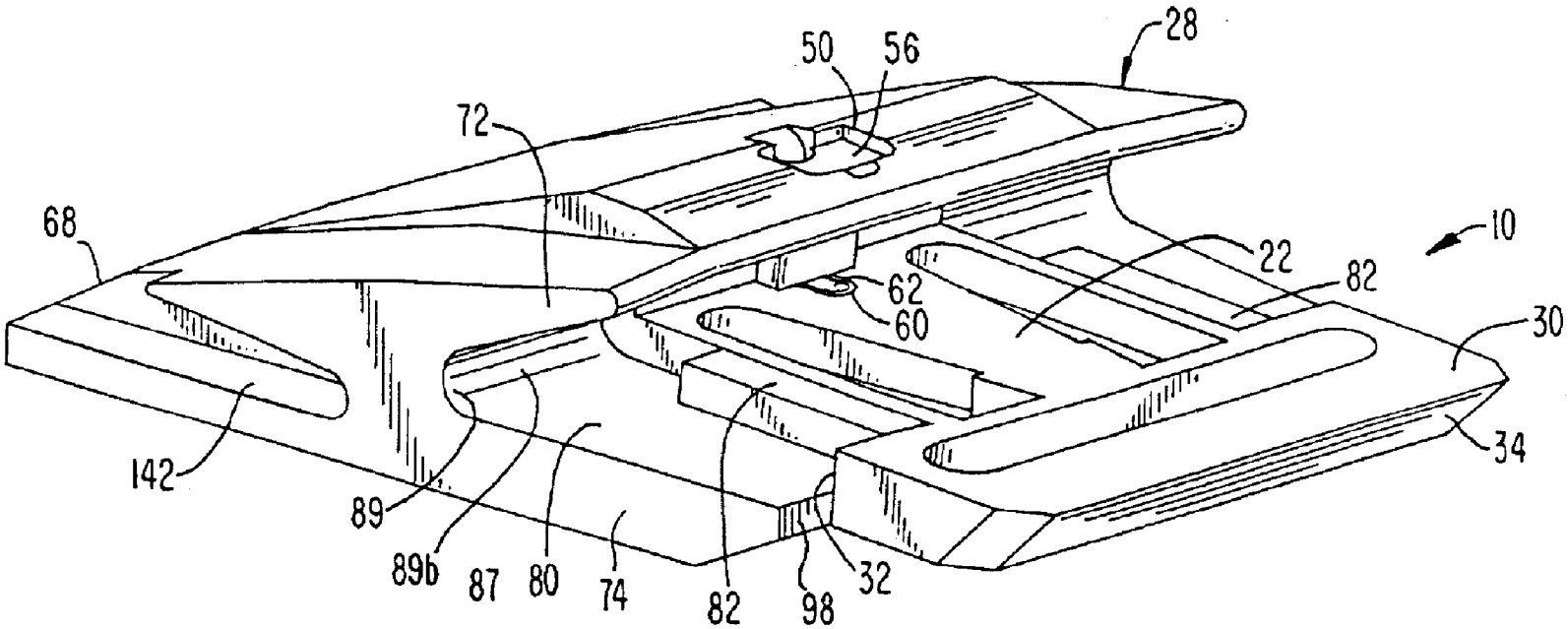
FIG. 18 is a rear perspective view of the wear assembly with the lip omitteduse.

Shroud 28 includes an inner surface 85 that includes inner face 80 of outer leg 74, inner face 87 of inner leg 72, and the inner comer surface 89 at the intersection of legs 72, 74 (FIGS. 13–16 and 18). Inner corner surface 89 has a central section 89*a* that generally matches front face 48 of boss 20 and abuts against it. Accordingly, in the preferred embodiment, inner corner surface 89 has a generally uniform curved surface. When assembled, inner face 80 of outer leg 74 overlies body 22 and outer face 14*b*, 16*b*, and inner face 87 of inner leg 72 overlies finger portion 39 and inner face 14*a*, 16*a* (FIGS. 16–18). Inside corner surface 89 also includes side sections 89*b* that have a slightly narrower radius of curvature than central section 89*a* to define side faces 91 that set just outside side surfaces 93 of front part 38 (FIGS. 3, 4 and 15). The juxtaposition of side faces 91 and side surfaces 93 will provide additional lateral support for shroud 28 at the front edge of lip 12. Although all of the bosses 20 are preferably identical, a unique boss could be formed for the center of central section 14 of lip 12 where a peak 100 is formed. In this construction, the inner surface of the boss that wraps around the front edge of the lip would be formed with slight angle to match the formation of the lip. Inner leg 72 includes an aperture 86 adapted to receive lock 56 therein. As a result, aperture 86 is generally aligned with recess 50, hole 52 and one of the scallops 18. In the preferred embodiment, aperture 86 has a generally rectangular configuration (to match the preferred lock) with the rear wall 88 forming bearing faces to abut the lock. As described below, rear wall 88 and front wall 92 each include a central groove 94, 96 (FIG. 13). Groove 94 is formed to provide clearance for the movement of an elastomer in the lock. Groove 96 is provided to permit the insertion of a pry tool for removing the lock. The rear and front walls 88, 92 of aperture 86 preferably-converge toward each other as they extend toward boss 20 to receive a tapered lock that can be pried into and out of the assembly. A rib 62 projects upward from inner face 80 to abut the lower end of lock 56.

Figure 1:
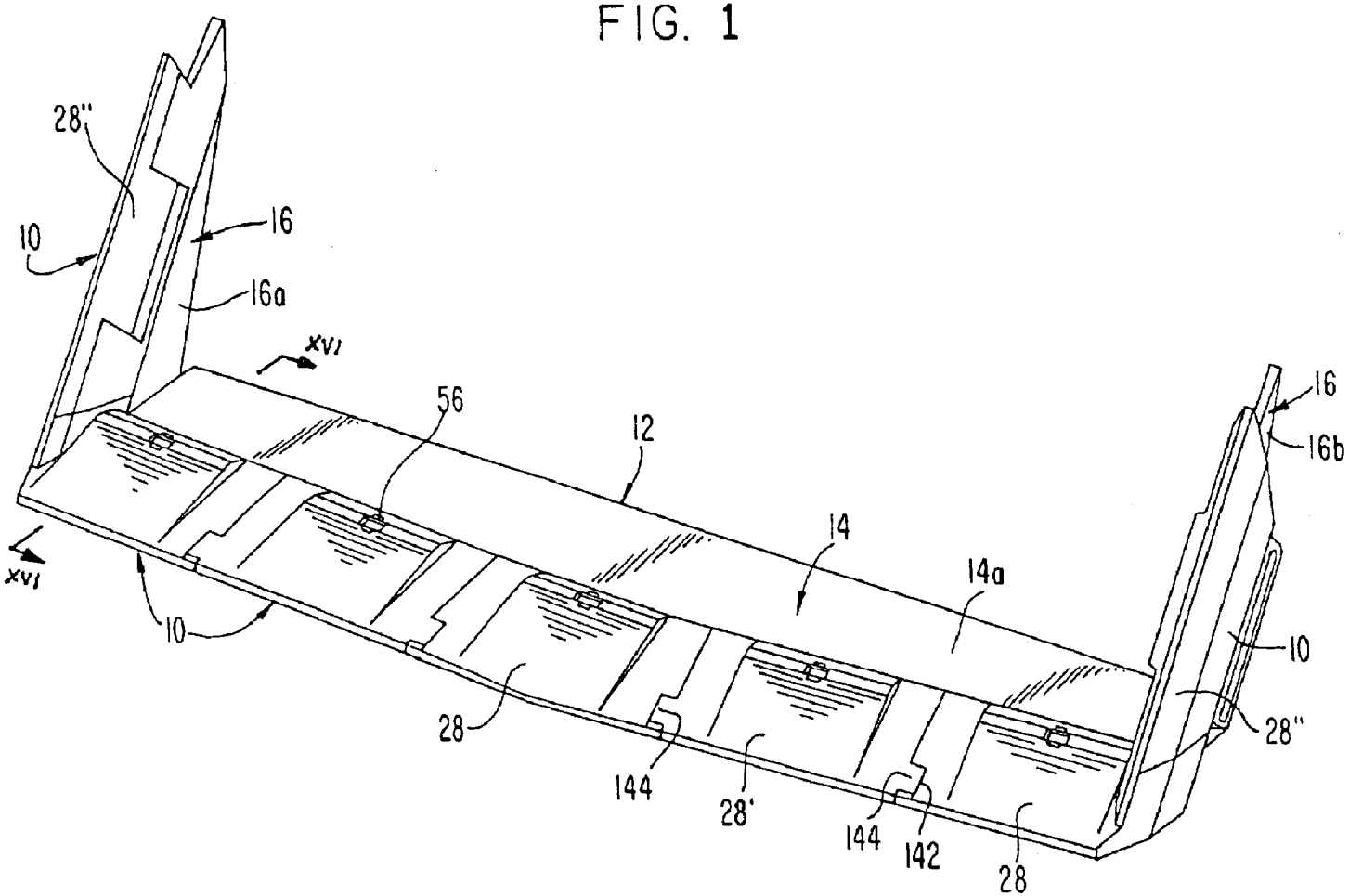
FIG. 1 is a perspective view of a lip of an excavating bucket provided with wear assemblies in accordance with the present invention.

When shroud 28 is installed, it is slid over lip 12 such that inner and outer legs 72, 74 straddle the lip (FIG. 1). Rails 24 of body 22 are fit within slot 84 as shroud 28 is moved rearward (FIG. 18). The rearward movement is continued until inside corner surface 89 abuts front face 48 of boss 20 (FIGS. 16–18). At this juncture, rear wall 98 of outer leg 74 is preferably placed in close proximity to stop surface 32. With cast parts, it is not practical for inside comer surface 89 and rear wall 98 to simultaneously abut front face 48 and stop surface 32, respectively. However, by placing rear wall 98 in close proximity with stop surface 32, the two surfaces will typically abut after a short amount of time as wear develops in the parts. While it is not preferred, stop surface 32 could be the primary bearing surface that first abuts rear wall 98, with inside corner surface 89 abutting front face 48 after some wear. Also, as shroud 28 is installed, rib 62 passes through groove 64 in front part 38 of boss 20, through main portion 58 of hole 52, and into pocket 60.

Figure 19:
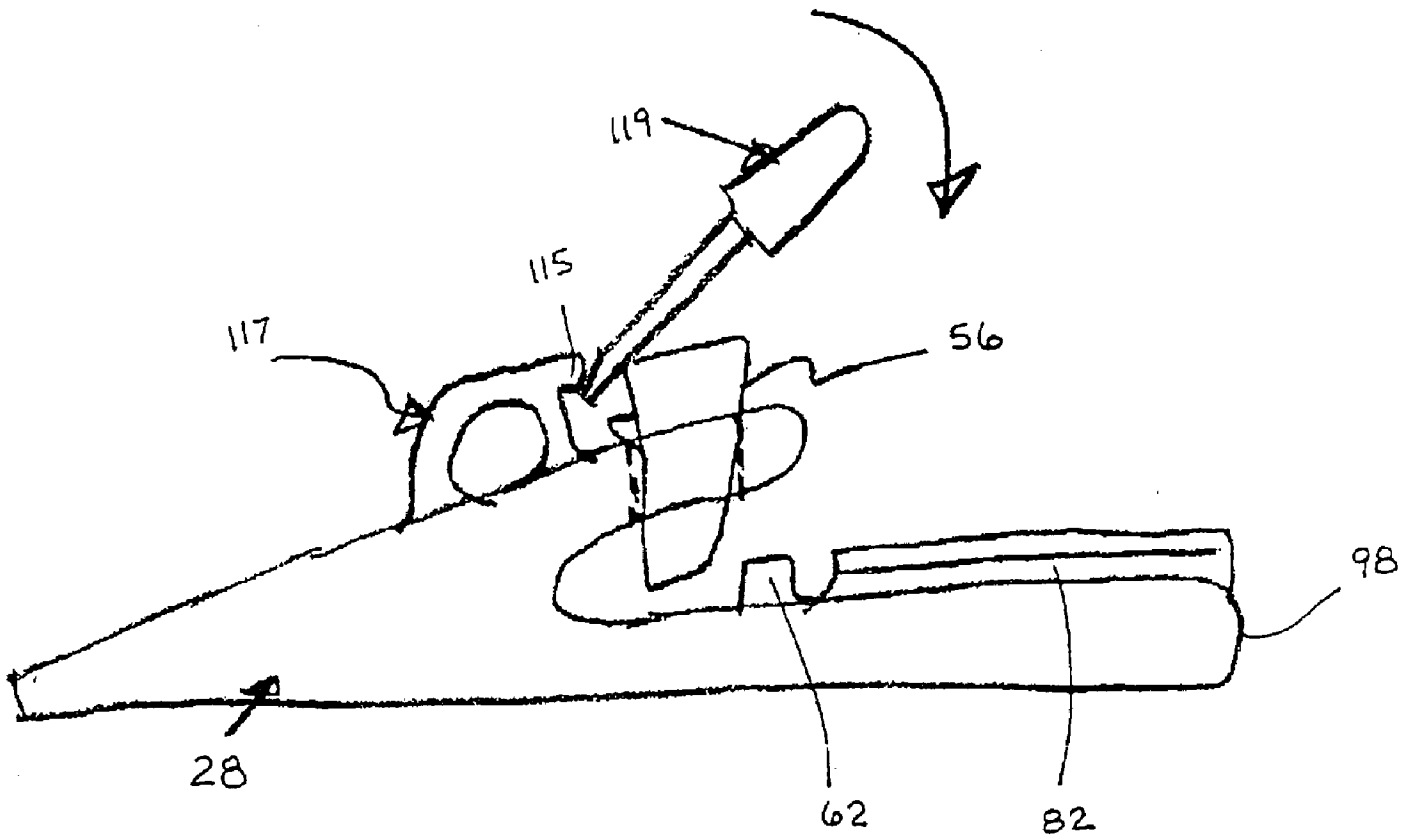
FIG. 19 is a side view of the wear member provided with a lifting eye.

Once shroud 28 is fully pushed onto boss 20, lock 56 is inserted into aperture 86, recess 50, hole 52 and one of the scallops 18 (FIGS. 16–18). As seen in FIGS. 9–12, lock 56 preferably has a rigid body 102, a latch 104 and an elastomeric member (not shown). In the preferred construction, body 102 has a gradually tapering shape with front and rear walls 106, 108 that converge as they extend toward leading face 110. Rear wall 108 is divided by a step 112 into an upper or inner section 108*a* and a lower or outer section 108*b*. Preferably the inner and outer sections 108*a*, 108*b* are generally parallel to each other, although they could have differing orientations. Inner section 108*a* is adapted to set against rear wall 88 in aperture 86, and outer section 108*b* against the front face 114 of rib 62. Accordingly, rear wall 88 and front face 114 are preferably inclined to match the inclination of rear wall 108. As disclosed in co-pending U.S. patent application Ser. No. 10/187,446 filed Jul. 2, 2002, entitled "Coupling for Excavating Wear Part," which is hereby incorporated by reference in its entirety, this mating relationship of a tapered lock with the opening into which it is received eases the insertion and removal of the lock; that is, since the lock walls do not fully engage the opening walls until the lock is fully set in the assembly, the necessity for using a large hammer to insert the lock is obviated. Rather, in certain environments, it is possible to manually insert the lock into the assembly without tools. Alternatively, a pry tool may be used. In the example illustrated in FIG. 19, a prying ledge 115 is provided on a lifting eye 117. A pry tool 119 can engage prying ledge 115 to push lock 56 into the assembly. Of course, other prying arrangements are possible, and a hammer could be used if desired. Similarly, since the lock will release from the opening walls immediately after being moved in the release direction, the lock can be pried out of the assembly.

Figure 11:
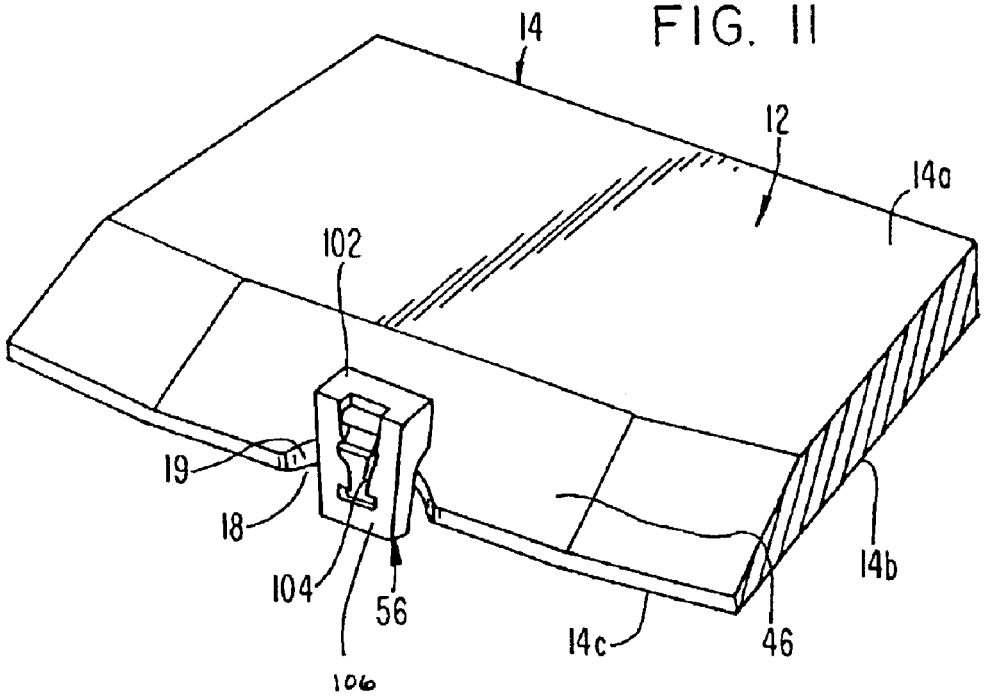
FIG. 11 is a perspective view of the lock and its relation to the lip during use.
Figure 12:
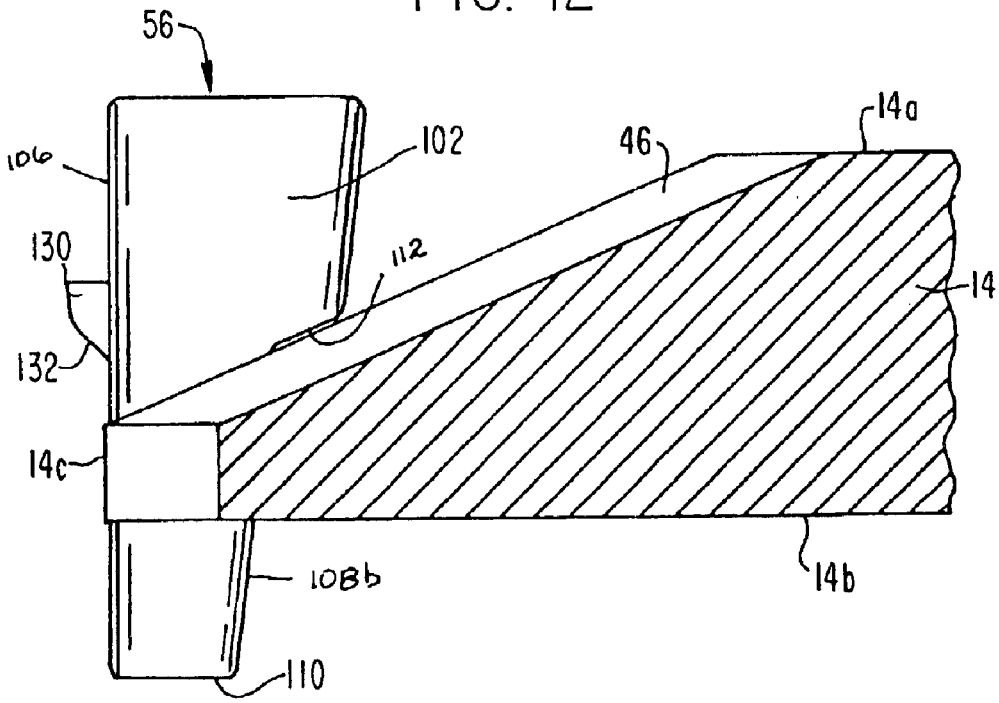
FIG. 12 is a side view of the lock and its relation to the lip during use.

The use of step 112 permits a larger, more robust portion of the lock to be fit within aperture 86 and to include a cavity 116 to contain the elastomeric material (not shown). The narrower portion below step 112 permits the use of a scallop 18 having minimal depth. When assembled, scallop wall 19 is juxtaposed to outer section 108*b* just below step 112 (FIGS. 11–12). Rib 62 sets just below lip 12 so that the inner or top surface 118 is juxtaposed to outer surface 14*b*, 16*b* of lip 12 (FIG. 16). Step 112 generally parallels ramp 46 in a spaced relation (FIGS. 11–12). Front wall 106 abuts against main wall 57 in recess 50 of boss 20 and front wall 120 of hole 52 (FIGS. 3 and 17–19). As can be appreciated, the lock, along both front wall 106 and rear wall 108 abuts shroud 28 and boss 20 inside and outside of lip 12 (i.e., to each side of a central plane of the main member 14 or corner member 16 between inner face 14*a*, 16*a* and outer face 14*b*, 16*b*) for a more stable and balanced locking arrangement than the prior art assemblies.

Figure 9:
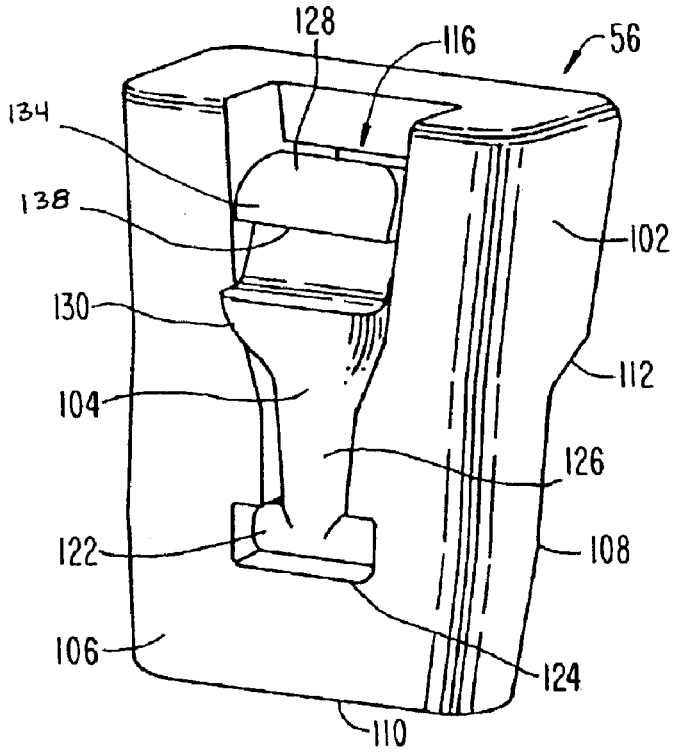
FIG. 9 is a perspective view of a lock in accordance with the present invention with the elastomer omitted.
Figure 10:
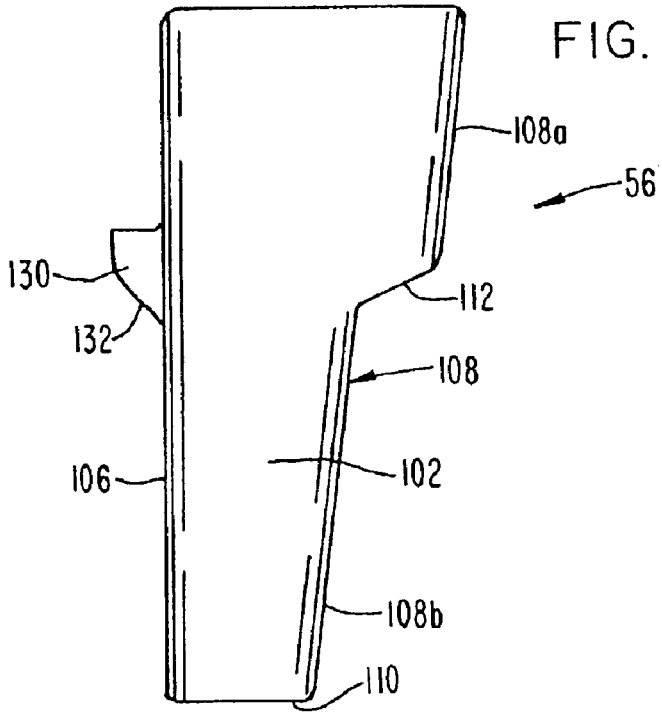
FIG. 10 is a side view of the lock.

Latch 104 is preferably pivotally mounted within cavity 116 of body 102 (FIGS. 9–10). In particular, latch 104 includes a pivot pin 122 that fits within a lateral recess 124, a stem 126, and a head 128. Head 128 includes a shoulder 130 that projects outward beyond front wall 106 to fit under keeper ledge 59 to retain lock 56 in the wear assembly. An elastomeric material (not shown), such as rubber, is fit within cavity 116 behind latch 104. The elastomer normally biases latch 104 outward in a locked position, as shown in FIG. 10. The leading or lower surface 132 of shoulder 130 has a curved configuration to guide the latch rearward as it strikes against shroud 28 as it is inserted into aperture 86 so that shoulder 130 is pushed within cavity 116. When the lock is fully inserted into the assembly, the elastomer biases the latch outward so that shoulder 130 fits under keeper ledge 59. In the preferred construction, the elastomer is affixed to the rear wall of latch 104 and within cavity 116 by adhesive or molding. Alternatively, the elastomer could be held within cavity by friction and/or mechanical means.

To facilitate removal of lock 56, shroud 28 includes groove 96 to permit the insertion of a tool (not shown) to push the latch rearward against the bias of the elastomer (FIGS. 9, 13, 16 and 17); that is, the tool presses against the front face 134 of head 128 with leverage against the front wall 136 of groove 96. Front wall 136 is curved inward to better guide latch 104 rearward, and provide a better leverage surface for the tool. Head 128 preferably also includes a pry surface 138 under front face 134, whereby the tool pushing the latch rearward can be further rotated against front wall 136 to pry the lock from the assembly (FIGS. 9 and 10); that is, the free end of the tool engages pry surface 138 so that as the tool continues to rotate it applies an upward force on the latch. The pivot pin 122 being received within recess 124 provides the needed resistance to permit such prying on the latch. In general, a pry tool (not shown) can be fit into groove 96 with a pry surface (not shown) to pull the lock from the assembly.

Shrouds 28 are preferably formed of two different constructions along their sides. As seen in FIGS. 1 and 13–16, one kind of shroud 28 includes grooves 142 which receive tongues 144 from the other kind of shroud 28' (FIG. 1). In this way, the shrouds mate together, with the tongues 144 in grooves 142 to provide a more integral assembly and better cover front edge 14*c* of lip 12. A third kind of shroud 28" can be formed without grooves 142 or tongues 144 for attachment to corner sections 16. Nevertheless, a shroud of a single shape of can be used if desired. For instance, each shroud can be formed with a groove on side and a tongue on the other, or each could be formed without either a groove or tongue.

What is claimed is:

1. A wear assembly for attachment to an excavator having a lip with an inner face, an outer face and a front edge face, the wear assembly comprising:

a boss adapted to be fixed to the lip, the boss including a front part having a first face extending generally along the front edge face of the lip, a body extending rearwardly of the front part along one of the inner and outer faces of the lip and a passage that opens to a side by the inner face and to a side by the outer face, the passage including a first bearing surface facing in a generally rearward direction, the front part and the body defining a gap for receipt of the lip with the gap being laterally open at opposite ends of the first face to accommodate a lateral extension of the lip;

a wear member received over the boss and including an aperture generally aligned with the passage, and a second bearing surface associated with the aperture and facing in a generally forward direction; and a lock received in the aperture and the passage to be in opposition to the first and second bearing surfaces to hold the wear member to the boss.

2. A wear assembly in accordance with claim 1 wherein the front part wraps around the lip and extends partially along at least one of the inner and outer faces opposite the body.

3. A wear assembly in accordance with claim 1 in which the wear member includes a leg that overlies the body, wherein the leg and the body define a cooperative tongue and groove construction whereby the leg is held to the lip.

4. A wear assembly in accordance with claim 3 in which the body defines the tongue and the leg defines the groove.

5. A wear assembly in accordance with claim 3 wherein the body includes at least one holding surface spaced from and facing the lip and the leg includes a retaining member between the holding surface and the lip to hold the wear member to the lip.

6. A wear assembly in accordance with claim 3 wherein the body defines the groove and the leg defines the tongue received in the groove.

7. A wear assembly in accordance with claim 1 wherein the body includes sides extending generally away from the front edge face of the lip, each side including a rail, and each rail including a holding surface spaced from and facing the lip to hold the wear member to the lip.

8. A wear assembly in accordance with claim 7 wherein the body with the rails defines a T-shaped configuration.

9. A wear assembly in accordance with claim 7 wherein the rails have a dovetail configuration.

10. A wear assembly in accordance with claim 7 in which the boss further includes a brace rearward of the body that extends laterally outward of at least a portion of the body and is fixed to the rails.

11. A wear assembly in accordance with claim 10 wherein the brace includes a forwardly facing abutting surface and the leg includes a rear wall that is adapted to abut the abutting surface.

12. A wear assembly in accordance with claim 10 in which the brace extends outward away from the lip farther than the body.

13. A wear assembly in accordance with claim 12 in which the brace includes a generally rearward facing deflector surface that is inclined forward and away from the lip.

14. A wear assembly in accordance with claim 1 in which the wear member includes a third bearing surface to oppose the lock, wherein the second and third bearing surfaces are spaced apart in a direction generally transverse to the lip.

15. A wear assembly in accordance with claim 14 in which the wear member includes a rib to define the third bearing surface and the front part of the boss includes a groove extending therethrough to communicate with the passage, wherein the rib passes through the groove when the wear member is installed on the lip.

16. A wear assembly in accordance with claim 15 wherein the boss further includes a pocket aligned with the groove on an opposite side of the passage to receive the rib when the wear member is installed on the lip.

17. A wear assembly in accordance with claim 1 wherein the wear member includes one of a tongue and groove on each side thereof to mate with an adjacent other one of the wear members attached to the lip.

18. A wear assembly In accordance with claim 1 which the wear member is bifurcated to define spaced apart legs, wherein a first of the legs includes the aperture and a second of the legs includes a rib extending toward the aperture, and wherein the rib includes a third bearing surface to oppose the lock and hold the wear member to the lip.

19. A wear assembly in accordance with claim 1 wherein the lock has front and rear surfaces that are tapered toward a leading end, and wherein the passage and the aperture are each tapered in the same direction to receive the lock.

20. A wear assembly in accordance with claim 19 wherein the lock has a movable latch that engages a keeper in the passage to secure the lock in the assembly.

21. A wear assembly for attachment to an excavator having a lip with an inner face, an outer face and a front edge face, the lip defining a central plane extending medially between the inner and outer faces, the wear assembly comprising:

a boss adapted to be fixed to the lip and including a first bearing surface facing generally in a rearward direction;

a wear member received over the boss and including an aperture, a second bearing surface and a third bearing surface, the second bearing surface being on an inner side of the central plane, and the third bearing surfaces being on an outer side of the central plane, each of the second and third bearing surfaces facing in a generally forward direction; and a lock received in the aperture to be in opposition to the bearing surfaces to hold the wear member to the boss.

22. A wear assembly in accordance with claim 21 wherein the boss includes a front part that wraps around the lip and extends partially along at least one of the inner and outer faces and a body that extends along the other of the inner and outer sides of the lip.

23. A wear assembly in accordance with claim 22 in which the wear member includes a leg that overlies the body, wherein the leg and the body define a cooperative tongue and groove construction whereby the leg is held to the lip.

24. A wear assembly in accordance with claim 23 in which the body defines the tongue and the leg defines the groove.

25. A wear assembly in accordance with claim 23 in which the body defines the groove and the leg defines the tongue.

26. A wear assembly in accordance with claim 23 wherein the body includes sides extending generally away from the front edge face of the lip, each side including a rail, and each rail including a holding surface spaced from and facing the lip to hold the wear member to the lip.

27. A wear assembly in accordance with claim 26 wherein the body with the rails defines a T-shaped configuration.

28. A wear assembly in accordance with claim 26 wherein the rails have a dovetail configuration.

29. A wear assembly in accordance with claim 26 in which the boss further includes a brace rearward of the body that extends laterally outward of at least a portion of the body and is fixed to the rails.

30. A wear assembly in accordance with claim 29 in which the brace extends outward away from the lip farther than the body.

31. A wear assembly in accordance with claim 21 wherein the boss includes a brace having a forwardly facing abutting surface, and wherein the wear member includes a rear wall that is adapted to abut the abutting surface.

32. A wear assembly in accordance with claim 21 in which the wear member includes a rib to define the third bearing surface.

33. A wear assembly in accordance with claim 32 wherein the boss includes a front surface and a groove that opens in the front surface and extends rearward through a portion of the boss, wherein the rib passes through the groove and into the assembly when the wear member is installed on the lip.

34. A wear assembly in accordance with claim 21 wherein the lock has front and rear surfaces that are tapered toward a leading end, and wherein the aperture is tapered in the same direction to receive the lock.

35. A wear assembly in accordance with claim 34 wherein the lock has a movable latch that engages a keeper in the aperture to secure the lock in the assembly.

36. A wear member for attaching to a lip of an excavator wherein a boss is fixed to the lip, the wear member comprising:

a front working portion; and a rear mounting portion adapted to overlie the boss when installed on the lip, the rear mounting portion including a pair of legs, a first of the legs including an aperture for receiving a lock therein, and a second of the legs including a rib generally opposed to the aperture and extending toward the aperture, the aperture and the rib each including a face to engage the lock and hold the wear member to the lip.

37. A wear member in accordance with claim 36 further including retaining members with holding surfaces spaced from and facing one of the legs to cooperate with complementary holding surfaces of the boss to hold the leg to the lip.

38. A wear member in accordance with claim 37 wherein the retaining members define a slot into which a portion of the boss is received.

39. A wear member in accordance with claim 38 wherein the retaining members are shaped as dogleg flanges extending outward from one of the legs.

40. A wear member in accordance with claim 39 wherein the retaining members define a tongue to be received in a slot in the boss.

41. A wear member in accordance with claim 36 wherein one of the legs includes at a rear end thereof a deflector face inclined outward and forward from the lip to deflect earthen material away from the wear member when the excavator is moved in a reverse direction.

42. A wear member in accordance with claim 36 wherein the wear member includes one of a tongue and groove on each side thereof to mate with an adjacent another one of the wear members attached to the lip.

43. A wear member in accordance with claim 36 wherein the aperture includes a front wall and a rear wall that taper toward each other.

44. A boss for attachment of a wear member to a lip of an excavator, the lip having an inner face, an outer face and a front edge face interconnecting the inner and outer faces, the boss comprising:

a front part extending along a front edge face of the lip and having a forwardly facing front surface;

a body extending rearwardly of the front part and along one of the inner and outer faces of the lip;

an opening for receiving a lock securing the wear member to the boss; and a groove in the front part that opens in the front surface and in the opening for the passage of a part of a wear member to the opening to cooperate with the lock.

45. A boss in accordance with claim 44 wherein the front part extends partially along one of the inner and outer faces opposite the body.

46. A boss in accordance with claim 45 in which the front part and the body each includes a hole, wherein the holes are aligned to define the opening in the body.

47. A boss in accordance with claim 46 wherein each of the holes in the front part and the body includes a generally rearward facing bearing surface adapted to abut a lock holding the wear member to the lip.

48. A boss in accordance with claim 44 wherein the body includes sides extending generally away from the front edge face of the lip, each side including a rail, and each rail including a holding surface spaced from and facing the lip to hold a wear member to the lip.

49. A boss in accordance with claim 48 wherein the body with the rails defines a T-shaped configuration.

50. A boss in accordance with claim 48 wherein the rails have a dovetail configuration.

51. A boss in accordance with claim 48 which the boss further includes a brace rearward of the body that extends beyond at least a portion of the body in a transverse direction and is fixed to the rails.

52. A boss in accordance with claim 51 in which the brace extends outward away from the lip farther than the body.

53. A boss in accordance with claim 52 in which the brace includes a generally rearward facing deflector surface that is inclined forward and away from the lip.

54. A boss for attachment of a wear member to a lip of an excavator, the lip having an inner face, an outer face and a front edge face interconnecting the inner and outer faces, the boss comprising:

a body including an inner surface adapted to be fixed to one of the inner and outer faces of the lip, and a pair of spaced rails, each rail including a holding surface spaced outward of the inner surface and facing generally in the same direction as the inner surface to hold a wear member to the lip; and a brace rearward of the body and having an inner face adapted to be fixed to the lip, and a front face fixed to the rails to provide support therefor.

55. A boss in accordance with claim 54 further including a front part that wraps around the lip and extends partially along at least one of the inner and outer faces opposite the body.

56. A boss in accordance with claim 55 further including an opening for receiving a lock.

57. A boss in accordance with claim 54 wherein the body with the rails defines a T-shaped configuration.

58. A boss in accordance with claim 54 wherein the rails have a dovetail configuration.

59. A boss in accordance with claim 54 further including a front surface and a groove that opens in the front surface and extends rearward into the boss to receive a part of the wear member.

60. A boss for attachment of a wear member to a lip of an excavator, the lip having an inner face, an outer face and a front edge face interconnecting the inner and outer faces, the boss comprising:

a body including an inner surface adapted to be fixed to one of the inner and outer faces of the lip, the body being adapted to be received in a corresponding groove formed in the wear member; and a brace rearward of the body and having an inner face adapted to be fixed to the lip, and a front face that extends beyond the body in a transverse direction to form an abutment against which a rear wall of the wear member abuts so as to resist rearward deflection of the wear member.

61. A boss in accordance with claim 60 wherein the boss includes rails extending away from the front edge face, each rail defining a rear end, and wherein the brace is fixed to the rear ends of the rails on each said side of the body.

62. A boss in accordance with claim 61 in which the brace extends outward away from the lip farther than the body.

63. A boss in accordance with claim 60 in which the brace extends outward away from the lip farther than the body.

64. A boss in accordance with claim 60 in which the brace includes a generally rearward facing deflector surface that is inclined forward and away from the lip.

65. A wear assembly in accordance with claim 1 in which the boss further includes a brace rearward of the body and extending laterally outward of at least a portion of the body.

66. A wear assembly in accordance with claim 65 wherein the brace includes a forwardly facing abutting surface that abuts the wear member to resist rearwardly directed forces thereon.

67. A wear assembly in accordance with claim 1 wherein the lock has a movable latch to releasably secure the lock in the assembly.

68. A wear assembly in accordance with claim 1 wherein the boss is a one-piece member.

69. A wear assembly in accordance with claim 1 wherein the boss is composed of a plurality of members.

70. A wear assembly in accordance with claim 21 in which the boss further includes a brace rearward of the body and extending laterally outward of at least a portion of the body.

71. A wear assembly in accordance with claim 21 wherein the brace includes a forwardly facing abutting surface that abuts the wear member to resist rearwardly directed forces thereon.

72. A wear assembly in accordance with claim 21 wherein the lock has a movable latch to releasably secure the lock in the assembly.

73. A wear assembly in accordance with claim 21 wherein the boss is a one-piece member.

74. A wear assembly in accordance with claim 21 wherein the boss is composed of a plurality of members.

75. A boss in accordance with claim 44 further including a brace rearward of the body and extending extends laterally outward of at least a portion of the body, the brace having a forwardly facing abutting surface that abuts the wear member to resist rearwardly directed forces thereon.

76. A boss in accordance with claim 44 formed as a one-piece member.

77. A boss in accordance with claim 44 which is composed of a plurality of members.

78. A boss in accordance with claim 54 wherein the brace includes a forwardly facing abutting surface that abuts the wear member to resist rearwardly directed forces thereon.

79. A boss in accordance with claim 54 formed as a one-piece member.

80. A boss in accordance with claim 54 which is composed of a plurality of members.

81. A boss in accordance with claim 60 formed as a one-piece member.

82. A boss in accordance with claim 60 which is composed of a plurality of members.

83. A boss in accordance with claim 60 further comprising a pair of rails, each rail including a holding surface spaced outward of the inner surface and facing generally in the same direction as the inner surface to hold a wear member to the lip.

84. A boss for attachment of a wear member to a lip of an excavator, the lip having an inner face, an outer face and a front edge face interconnecting the inner and outer faces, the boss comprising:

a front part extending along the front edge face of the lip and at least partially extending transversely outward of one of the inner and outer faces of the lip, the front part including a rearward facing end wall transversely outward of one of the inner and outer faces to abut a lock to hold the wear member in place;

a body extending rearward of the front part and along one of the inner or outer faces of the lip, the body being on a side of the lip opposite the end wall of the front part, the body having an inner surface to be fixed to the lip and opposite sidewalls, each sidewall including a rail projecting therefrom and spaced from the inner surface so as to be spaced from the lip when the boss is attached thereto; and an opening for receiving a lock securing the wear member to the boss.

85. A boss in accordance with claim 84 formed as a one-piece member.

86. A boss in accordance with claim 85 which is composed of a plurality of members.

87. A wear assembly for attachment to an excavator having a lip with an inner face, an outer face and a front edge face, the wear assembly comprising:

a boss adapted to be fixed the lip, the boss including a body extending generally away from the front edge face along one of the inner and outer faces, and a brace rearward of the body and extending transverse to the body, the brace including a forwardly facing abutting surface;

a wear member including a groove to receive the body of the boss, and a rear wall to abut the forwardly facing abutting surface and resist rearward directed forces on the wear member; and a lock to hold the wear member to the lip.

88. A wear assembly in accordance with claim 87 wherein the body includes rails and the wear member includes grooves for receiving the rails.

89. A wear assembly in accordance with claim 88 wherein the rails are fixed to the brace.

90. A wear assembly in accordance with claim 87 wherein the boss is a one-piece member.

91. A wear assembly in accordance with claim 87 wherein the boss is composed of a plurality of members.

92. A wear assembly in accordance with claim 87 wherein the boss includes a rearward facing bearing surface, and the wear member includes an aperture provided with a bearing surface facing in a generally forward direction, the bearing surfaces of the boss and wear member abut opposite sides of the lock to hold the wear member to the lip.

* * * * *

UNITED STATES PATENT AND TRADEMARK OFFICE

CERTIFICATE OF CORRECTION

PATENT NO. : 7,080,470 B2
APPLICATION NO. : 10/425605
DATED : July 25, 2006
INVENTOR(S) : Larren F. Jones It is certified that error appears in the above-identified patent and that said Letters Patent is hereby corrected as shown below:

In Column 3, Line 29, “omitteduse” should be changed to --omitted--.

In Column 5, Line 4, “comer” should be changed to --corner--; Line 56, “comer” should be changed to --corner--.

In Column 6, Line 31, “comer” should be changed to --corner--.

In Column 8, Line 6, the text “of” should be deleted; Line 7, “on side” should be changed to --on one side--.

In Column 12, Line 60, the text “extends” should be deleted.

In Column 14, Line 8, “fixed the lip” should be changed to --fixed to the lip--.

Signed and Sealed this

Twenty-sixth Day of June, 2007

JON W. DUDAS
*Director of the United States Patent and Trademark Office*